United States Patent [19]

Holter

[11] 4,053,366

[45] Oct. 11, 1977

[54] COKE-OVEN PLANTS

[76] Inventor: Heinz Holter, 39-41 Beisenstrasse, Glabeck 439, Germany

[21] Appl. No.: 606,171

[22] Filed: Aug. 20, 1975

[30] Foreign Application Priority Data

Aug. 21, 1974 Germany ..... 2440014

[51] Int. Cl.[2] ..... C10B 39/00; C10B 39/04; C10B 39/14

[52] U.S. Cl. ..... 202/227; 202/263; 105/238 R

[58] Field of Search ..... 202/262, 263, 227, 228; 105/238 R

[56] References Cited

U.S. PATENT DOCUMENTS

| | | | |
|---|---|---|---|
| 3,716,457 | 2/1973 | Schon | 202/227 X |
| 3,746,626 | 7/1973 | Morrison, Jr. | 202/263 |
| 3,788,236 | 1/1974 | Edgar et al. | 202/227 X |
| 3,844,901 | 10/1974 | Roe et al. | 202/227 X |

FOREIGN PATENT DOCUMENTS

| | | | |
|---|---|---|---|
| 875,039 | 4/1953 | Germany | 202/227 |

*Primary Examiner*—Norman Yudkoff
*Assistant Examiner*—Barry I. Hollander
*Attorney, Agent, or Firm*—Friedman, Goodman & Teitelbaum

[57] ABSTRACT

A construction and design of coke-oven plant to handle fumes occurring in coke-oven plants, particularly those which are emitted during the pressing of coke from a coke-oven, and which subsequently arise from the coke quenching truck during transportation of the coke to the quenching tower. A deflector apron extends downwardly from the roof towards the quenching truck trackway, to trap fumes in the roof space behind the apron. An extractor duct extends lengthwise of the battery close to the roof, and control means establishes progressive communication between the extractor duct and successive regions of the roof space as the quenching truck passes therebetween.

10 Claims, 3 Drawing Figures

COKE-OVEN PLANTS

BACKGROUND OF THE INVENTION

1. Field of the Invention

This invention is concerned with improvements relating to coke-oven plants, in particular to the trapping and evacuating hot, dust-laden fumes occurring in coke plants, particularly those which are emitted during the pressing of coke from a coke-oven, and which subsequently arise from the coke quenching truck during transportation of the coke to the quenching tower.

2. Description of Prior Art

A variety of installations designed to deal with emissions of the kind set out above, which still constitute a major problem in coke-works, and to reduce environmental pollution, have been suggested. With a view to achieving a comprehensive evacuation by suction of the fumes, known arrangements provide for the roof of the plant which starts at the top edge of the oven roofs, to be extended downwardly on the side of the quenching truck to a point just above the floor, on which are mounted the truck rails, thereby creating a virtually fully enclosed shop-area from which the fumes are evacuated by an extractor duct. However, a comparatively high suction capacity is required to ensure that the emissions are quickly eliminated from the shop area. During the intervals between individual pressing operations the extractor fan capacity cannot be utilised economically because at this stage only the low-temperature producer gases emerging from the oven doors have to be drawn off. On the other hand, unless the suction capacity is sufficient to ensure that the emissions of one pressing operation will have been extracted by the time the next pressing operation is commenced, the emissions remaining in the shop area will constitute a permanent source of danger to the men working in this area, particularly also for the reason that as the gases cool down the heavier gases sink to the shop floor. Special extractor ducts must be provided on the floor to deal with these latter gases.

In addition, this type of a virtually fully enclosed work shop area also involves considerable static construction problems.

To overcome these problems, it has become customary to equip the quenching truck with a hood to trap the emissions and to conduct them toward fume extractors, the latter also being truck-mounted. This however involves expensive structural provisions and installations whilst frequently the desired result remains unachieved because the hood cannot always be made of adequate dimensions despite generously provided suction capacities. This means that the men working on the coke side of the coke-oven plant are still exposed to the emissions, and the latter still pollute the environment.

BRIEF SUMMARY OF THE INVENTION

It is one of the various objects of this invention to improve the extraction by suction of fumes in coke plants emitted during and/or subsequent to pressing of the coke thereby to improve the working conditions for the men working in the region of the quenching truck trackway and to reduce environmental pollution risks.

According to this invention there is provided a coke-oven plant comprising:

i. a battery of coke-ovens;

ii. a quenching truck;

iii. a trackway along which the quenching truck travels between the coke-ovens and a quenching tower;

iv. a roof extending lengthwise of the battery and from a position above the doors of the coke-ovens to a position above the trackway;

v. a deflector apron extending lengthwise of the battery and downwardly from the roof towards the quenching truck trackway, whereby fumes emitted from the quenching truck are trapped in a roof space behind the apron and beneath the roof;

vi. an extractor duct extending lengthwise of the battery; and vii. control means to establish progressive communication between the extractor duct and successive regions of said space as the quenching truck passes therebeneath.

A coke-oven plant of the kind set out in the last preceding paragraph avoids the disadvantages of a fully enclosed shop area because the area beneath the roof, where the men work, may be freely ventilated, but at the same time protected against the weather. Thus any emissions which sink to the floor may flow off freely over the ramp without presenting any danger to the men.

The emissions which occur during pressing of the coke, and during conveying of the coke to the quenching tower, may be extracted by a comparatively small suction capacity, because the suction duct for these emissions will be in communication with certain regions only of the roof space, whilst coke is being discharged from a coke-oven and whilst the coke is being conveyed to the quenching tower.

Preferably, at each of said regions, a branch pipe extends from the extractor duct and opens into the space behind the apron and beneath the roof, a valve being provided to close each such opening, and the control means being operative to open the valve associated with one branch pipe as the quenching truck passes beneath said region, and close the valve subsequent to departure of the truck beneath said region.

Conveniently, each branch pipe is connected to a plurality of openings in the roof, the valve associated with the branch pipe conveniently being in the form of a flap valve, and being located in the branch pipe adjacent the extractor duct. Advantageously, these flap valves are opened and closed in accordance with the position of the quenching truck by radio control means. In this manner, the valves associated with the openings immediately above the truck may be opened as the truck travels therebeneath along the trackway, thus ensuring that the fumes emitted by the quenching truck will pass into the extractor duct by the shortest possible route.

Preferably, the coke-oven plant comprises a second extractor duct extending lengthwise of the battery of coke-ovens adjacent the roof and close to the oven doors, said second duct continuously drawing off producer gas emerging from the oven doors.

The first of said suction ducts is conveniently positioned on the quenching truck side of the roof of the plant, which, together with a positioning of the second of said ducts on the coke-oven side of the roof, has the further advantage that the roof itself, and particularly the support provided on the quenching truck side, may be of much simpler construction because the operational loads and stresses to which these structural elements are subject is smaller.

Preferably, the quenching truck is provided with a device adapted to cause fumes emitted from the truck to be directed towards the region of the roof space above the quenching truck. Thus, the device may be adapted to co-operate with the apron to provide a chimney extending from the quenching truck towards the openings of the roof space which are in communication with the extractor duct.

Thus, the device preferably comprises a member adapted to co-operate with the deflector apron to provide, in conjunction therewith, a barrier extending upwardly from the outer side of the quenching truck to the roof, and means to create at least one, preferably two, air barriers, one extending upwardly from a forward region of the truck, and the other extending upwardly from a rearward region of the truck. In this manner, the chimney is provided by the combination of the solid barrier on the outer side of the quenching truck, and the air barriers forwardly and rearwardly of the truck, said air barriers imparting to the fumes emitted from the quenching truck an impulse in the direction towards the roof.

Preferably, said device is adjustably mounted on the truck, preferably for pivotal movement about an axis extending lengthwise of the truck on the side thereof nearest the coke-ovens, such pivotal movement conveniently being effected by hydraulic or pneumatic adjustable means. Conveniently, each air barrier is created by the flow of air under pressure into a duct, said air flowing from the duct through upwardly-directed apertures therein, the quenching truck being provided with an hydraulically powered fan to supply such air to said ducts.

Figure 1:
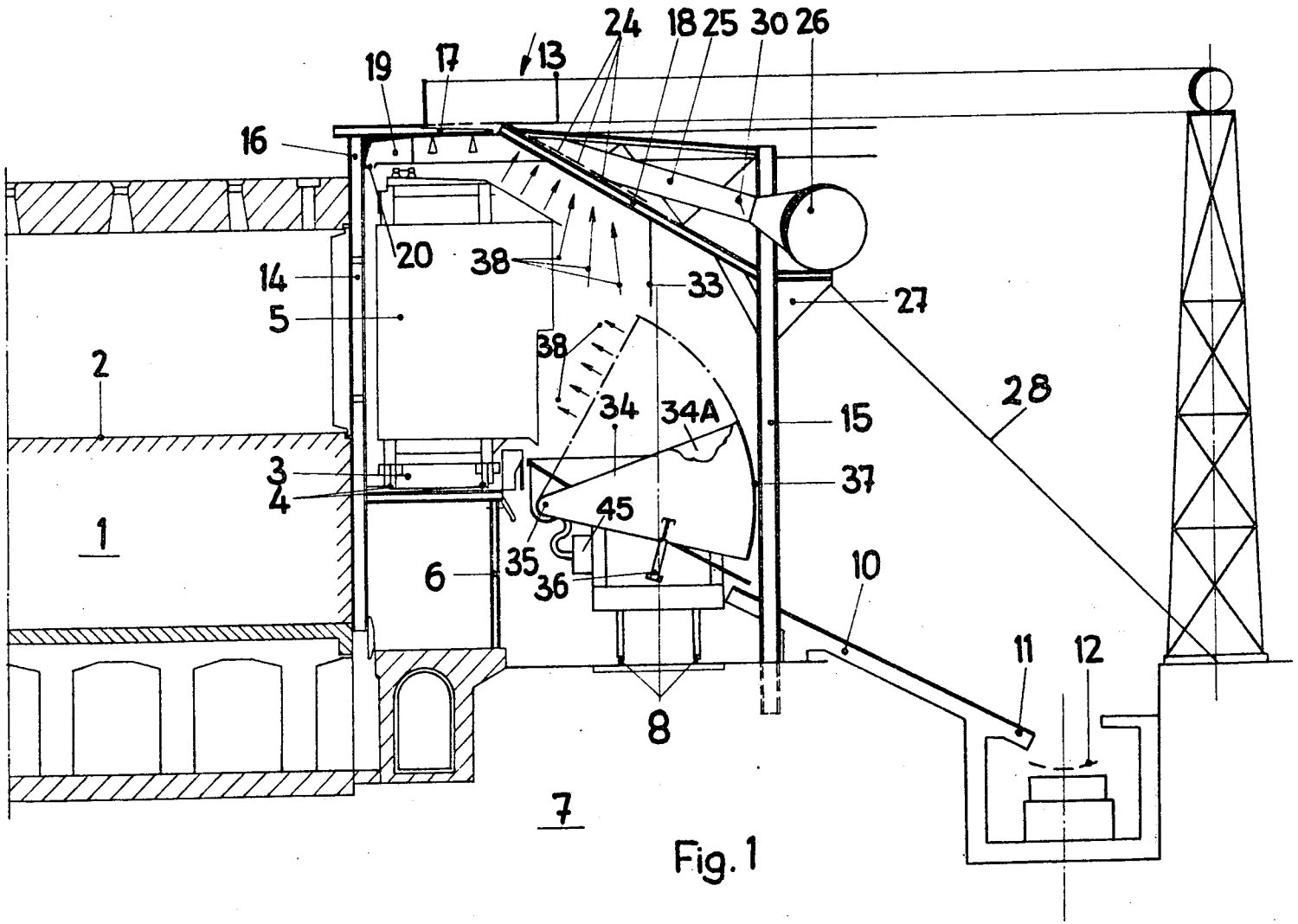
FIG. 1 is a cross-section through the coke side of a coke-oven plant whch is a preferred embodiment of this invention.
Figure 2:
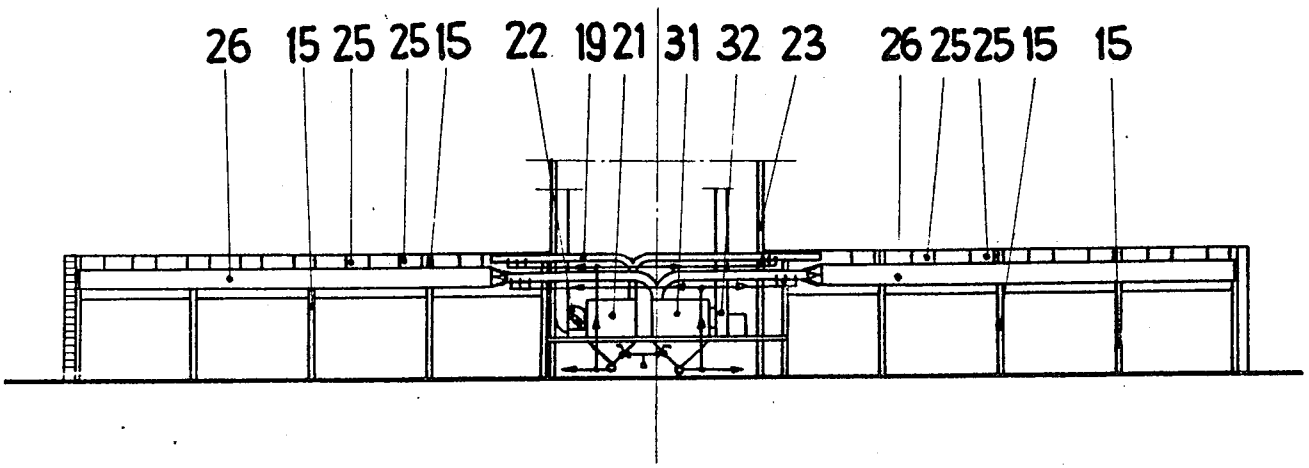
FIG. 2 is a lateral view of the coke side of the coke-oven plant.
Figure 3:
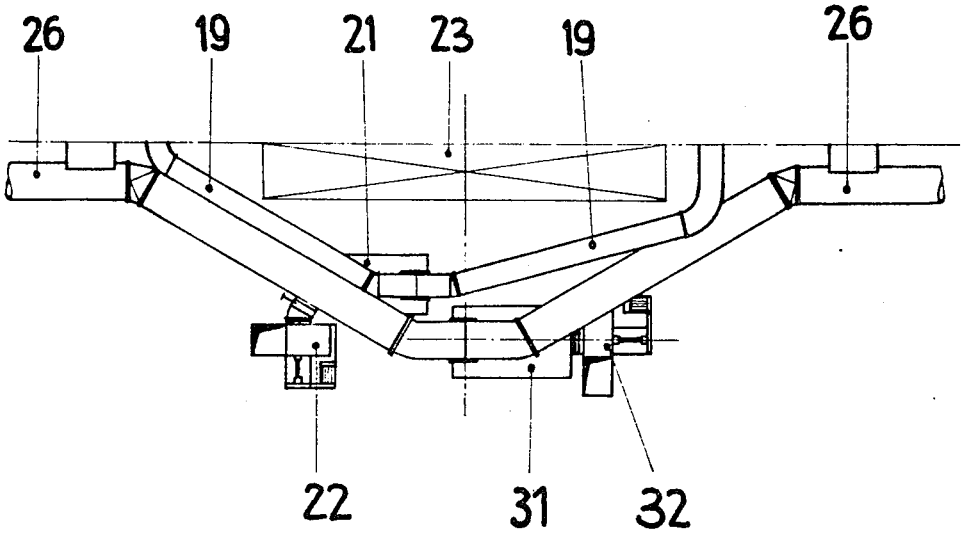
FIG. 3 is a partial plan view of the plant shown in FIG. 2 showing guide means for the extractor ducts in the region of a quenching tower.

DETAILED DESCRIPTION OF THE PREFERRED EMBODIMENT.

In the coke-oven plant which is the preferred embodiment of this invention, on the coke side of a coke-oven battery 1, and slightly below the furnace floor 2, there is provided a master gangway 3 with a rail trackway 4 for a coke pressing truck 5. This gangway is supported on one side by the coke-oven battery 1, and on the other side by supports 6 rising from the foundation bed 7. Adjacent to the gangway 3 a rail trackway 8 is provided on the foundation bed 7 for a quenching truck 9 which is adapted to travel alongside the coke-oven battery 1 between the coke ovens and a quenching tower 23. A sloping ramp 10 is provided on the outer side of the quenching truck trackway, a lower end 11 of the ramp 10 extending over a coke conveyor belt 12.

A roof 13 extends lengthwise of the battery of coke-ovens from a position above the doors of the ovens over the pressing truck 5 to a position above the trackway 8, said roof 13 being supported by supports 14 provided on the coke-oven battery and by further supports 15 arranged between the quenching truck trackway and the ramp 10. The roof 13 comprises a horizontal region 17 terminating by a vertical wall 16 on the coke side of the battery 1 and merging approximately half-way between the track ways 4 and 8 into a downwardly-inclined region 18 which terminates at the supports 15, (see FIG. 1), said inclined region 18 extending above the quenching truck 9.

The inclined region 18 of the roof 13 is provided with openings 24 to which are connected branch pipes 25 which in turn open into a primary extractor duct 26 which is mounted on brackets 27 fitted on the exterior side of the supports 15. The ducts 25 are relatively spaced apart in the illustrated example, by distances of approximately 5 meters, each being associated with one region of the roof space behind the apron 33 and beneath the roof 13.

Beneath the horizontal region 17 and on the side of the coke-ovens, there is provided a second extractor duct 19 provided with a substantially continuous and through-extending suction slot 20 on its underside and designed to trap and evacuate by suction producer gases which emerge from the oven doors. This extractor duct 19 is connected by extractor means 21 with a suction fan 22 provided in the region of the quenching tower 23, which is positioned approximately in the middle of the coke-oven battery 1. The capacity of the suction fan 22 is calculated to ensure that the producer gases which emerge from the oven doors will be constantly engaged by the air flow towards the slot 20 and evacuated through the duct 19. This arrangement provides reduction of moment forces applied to the supports 15 by the roof 13 and the ducts 19, 26. A tie-rod 28 secured to the upper portion of the support 15 and to the foundation bed takes up the residual bending and tilting moment forces.

The branch pipes 25 are provided with closing flap valves 30 adapted to be opened or closed by remote control, e.g. by radio control means. The suction duct 26 is connected by an extractor device 31 to a suction fan 32 which is located in the region of the quenching tower 23. The capacity of the suction fan 32 is calculated to ensure that the emissions which occur during a pressure operation, or during transport of the coke by the quenching truck, will be evacuated along the ducts 25 and 26. The closure flaps 30 of the ducts 25 are controlled in such a manner that at any given time only those valves 30 will be open which are actually situated above the truck 9. All the other valves 30 will be closed so that the full suction capacity of the fan 32 is concentrated in the region of the roof space above the truck 9.

For improving channelling of the quenching truck fumes a deflector apron 33 which extends lengthwise of the battery is suspended from the inclined region of the roof 13 and extends downwardly from the roof towards the trackway 8, said apron terminating a short distance from the upper edge of the truck 9 on the outer side thereof. This apron 33 coacts with a device fitted on the truck 9 to form a guiding funnel or chimney for the fumes emerging from the quenching truck causing said fumes to be directed towards the openings 24 in the roof 13 directly above the quenching truck, and to minimise tendency for the fumes to sink to the floor of the plant.

In the illustrated example the said device comprises means to create two air barriers, said means comprising tubular conduits 34 and 34A mounted at forward and rearward regions of the truck 9 on the side facing the coke-oven battery 1 for pivotal movement about mountings 35. Hydraulic rams 36 are provided at the front and rear of the truck 9 for pivoting said conduits 34 and 34A about axes provided by the mountings 35, said axes extending lengthwise of the truck on the side thereof nearest the coke-ovens. End portions of the conduits 34 and 34A are interconnected by a deflector member 37 which, when the conduits 34 and 34A are pivoted to positions shown in dotted lines in FIG. 1, forms a barrier between the truck 9 and the lower end of the deflector apron 33. When the conduits 34 and 34A are fully swung out their free ends extend to a position shortly in front of the deflector apron 33.

The conduits 34 and 34A are connected to at least one hydraulically driven fan 45 mounted on the truck 9 which draws air from the surrounding atmosphere and forces it through the conduits 34 and 34A to create a forced air draught issuing from slits provided on the side of the conduits 34 and 34A which points toward the roof 13 in the direction of the arrows 38, thereby forming an air-flow barrier at the front and rear ends of the truck 9 which barriers extend substantially over the total width of the shop and co-act with the part of the deflector apron 33 situated above the truck 9 to form a chimney between the quenching truck 9 and the openings 24 in the roof 13. This provides effective guidance for the quenching truck fumes both during coke pressing and during transport of the coke, ensuring that these fumes will arrive in the effective intake region of the extractor system at the openings 24. This arrangement minimizes the tendency for the fumes and gases emerging from the quenching truck to be dispersed over the remaining shop area.

I claim:

1. A coke-oven plant comprising:

i. a battery of coke-ovens;

ii. a quenching truck;

iii. a trackway along which the quenching truck travels between the coke-ovens and a quenching tower;

iv. a roof extending lengthwise of the battery from a position above the doors of the coke-ovens to a position above the trackway;

v. an extractor duct extending lengthwise of the battery and opening into a roof space beneath the roof;

vi. control means to establish progressive communication between the extractor duct and successive regions of said roof space as the quenching truck passes therebeneath; and vii. channelling means to cause fumes emitted from the quenching truck to be directed towards the roof space, said channeling means comprising:

a. a deflector apron extending lengthwise of the battery and downwardly from the roof towards the quenching truck trackway; and b. a barrier device mounted on the truck, said barrier device comprising a fume deflector member extending lengthwise of the truck and being mounted for movement towards the the coke-ovens from an inoperative to an operative position, and which, when in its operative position, cooperates with the deflector apron to provide, in conjunction therewith, a barrier extending upwardly from the outer side of the quenching truck to the roof.

2. A coke-oven plant according to claim 1 wherein at each of said regions, one branch pipe extends from the extractor duct and opens into the space behind the apron and beneath the roof, a valve being provided to close each such opening, and the control means being operative to open the valve associated with one branch pipe as the quenching truck passes beneath said region, and to close the valve subsequent to departure of the truck from beneath said region.

3. A coke-oven plant according to claim 2 wherein each branch pipe is connected to a plurality of openings in the roof, the valve associated with said branch pipe being located at the branch pipe adjacent the extractor duct.

4. A coke-oven plant according to claim 3 wherein the valves are in the form of flap valves.

5. A coke-oven plant according to claim 1 comprising radio control means to control communications between the extractor duct and said successive regions of said space.

6. A coke-oven plant according to claim 1 comprising a second extractor duct extending lengthwise of the battery of coke-ovens adjacent the roof and close to the coke-oven doors.

7. A coke-oven plant according to claim 1 wherein the deflector member is mounted on the quenching truck for pivotal movement about the axis which extends lengthwise of the truck on the side thereof nearest the coke-ovens, which deflector member when the barrier device is in its operative position extends to a position adjacent to a lower edge of the deflector apron.

8. A coke-oven plant according to claim 1 wherein the barrier device comprises means to create air barriers extending from the quenching truck upwardly from the forward and rearward regions of the truck.

9. A coke-oven plant according to claim 8 wherein said air barrier means comprises two air ducts mounted at forward and rearward ends of the truck and which extend widthwise of the truck, and fan means to force air into the ducts, such air issuing from the ducts, to provide forced air draughts directed towards the roof forming said air barriers.

10. A coke-oven plant according to claim 9 wherein the ducts are pivotally mounted on the truck, and the barrier member extends between the ducts on the outer side of the truck, means mounted on the truck being provided to move the ducts jointly about their pivotal mounting, and thus to move the barrier device as a whole between its operative and inoperative positions.

* * * * *